US011008782B2

(12) United States Patent
Jones et al.

(10) Patent No.: US 11,008,782 B2
(45) Date of Patent: May 18, 2021

(54) ATTACHABLE SECURITY CORD TETHER AND DEVICE

(71) Applicants: Gordon Jones, Boise, ID (US); Neal Doyle, Westwood, MA (US)

(72) Inventors: Gordon Jones, Boise, ID (US); Neal Doyle, Westwood, MA (US)

( * ) Notice: Subject to any disclaimer, the term of this patent is extended or adjusted under 35 U.S.C. 154(b) by 20 days.

(21) Appl. No.: 15/897,144

(22) Filed: Feb. 14, 2018

(65) Prior Publication Data

US 2019/0249462 A1 Aug. 15, 2019

(51) Int. Cl.
*E05B 73/00* (2006.01)
*E05B 55/00* (2006.01)

(52) U.S. Cl.
CPC ..... *E05B 73/0082* (2013.01); *E05B 73/0005* (2013.01); *E05B 55/005* (2013.01)

(58) Field of Classification Search
CPC ..... E05B 73/0082; E05B 73/0005; E05B 55/005; Y10T 70/5009; Y10T 70/409; Y10T 24/3933; F16G 11/02
See application file for complete search history.

(56) References Cited

U.S. PATENT DOCUMENTS 3,886,770 A * 6/1975 Smith ..... E05B 73/0005 70/18
4,185,361 A * 1/1980 Stuart ..... A63C 11/006 24/16 R
4,867,478 A * 9/1989 Anderson ..... A63C 11/005 280/814
5,026,088 A * 6/1991 Stuart ..... A63C 5/03 280/14.22
6,457,762 B1 * 10/2002 Garutti ..... A63C 11/006 224/257
9,603,446 B1 * 3/2017 Derman ..... A47B 21/06
2005/0241348 A1 * 11/2005 Devecki ..... B63C 11/02 70/18
2006/0032276 A1 * 2/2006 Early ..... E05B 73/0005 70/58
2010/0281930 A1 * 11/2010 Hacker ..... E05G 1/005 70/14
2015/0152669 A1 * 6/2015 Kindstrand ..... E05B 73/0005 70/15
2017/0267427 A1 * 9/2017 Martin ..... B65D 63/02

FOREIGN PATENT DOCUMENTS

EP 2610035 A1 * 7/2013 ..... B25B 25/00

* cited by examiner

*Primary Examiner* — Robert Sandy
*Assistant Examiner* — Louis A Mercado
(74) *Attorney, Agent, or Firm* — Furr Law Firm; Jeffrey M. Furr, Esq.

(57) ABSTRACT

A cable tether for computer and adapter security and theft Prevention. The cable tether has one or two loops at each end of the cable with a crimp-able metal sleeve. The end of the cable is attached to the sleeve forming the end of the loop while the cable loops back through the sleeve forming an adjustable loop. This end of the cable can slide within the sleeve. The loop is placed around the item to be protected or secured and cannot be removed. The loop is then pulled tight by pulling the cable through the sleeve. Once it is tight enough that sleeve is crimped against the cable holding it in place and forming a secure loop. This can be done at the other end to secure the item to a base, table or computer protecting it from getting lost or taken.

6 Claims, 5 Drawing Sheets

ATTACHABLE SECURITY CORD TETHER AND DEVICE

CROSS-REFERENCES TO RELATED APPLICATIONS (IF ANY)

None.

BACKGROUND

1. Field of the Invention

This invention relates to a security cord tether and device and in more particularly one that can attached to computer devices, Conference Display Adapters, MAC Adapters, APPLE Adapters, HDMI Adapters, VGA Adapters and other computer peripherals.

2. Description of Prior Art

The theft and loss of computer devices, and Conference Display Adapters, MAC Adapters, APPLE Adapters, HDMI Adapters, VGA Adapters and other computer peripherals are costly at any businesses and especially larger businesses as well as the lost productivity when these items cannot be found. Most of the protection security items for these types of devices are typically more expensive than the devices themselves.

There is still room for improvement in the art.

SUMMARY OF THE INVENTION

The current invention is a cable tether for computer and adapter security and theft Prevention. The cable tether has one loop at each end of the cable with a crimp-able metal sleeve. The end of the cable is permanently attached to the sleeve forming the end of the loop while the cable loops back through the sleeve forming the loop. The cable can slide within the sleeve making it adjustable. It is preassembled and permanent such as it is fixed and cannot be taken apart once installed to the item that is to be secured.

The loop is placed around the item to be protected or secured. The loop is then pulled tight by pulling the cable through the sleeve. Once it is tight enough that sleeve is crimped against the cable holding it in place and forming a secure loop. This can be done at the other end to secure the item to a base, table or computer protecting it from getting lost or taken.

The cable is made of a high-quality, flexible, stainless-steel coated wire cable.

BRIEF DESCRIPTION OF THE DRAWINGS

Without restricting the full scope of this invention, the preferred form of this invention is illustrated in the following drawings.

DESCRIPTION OF THE PREFERRED EMBODIMENT

Figure 1:
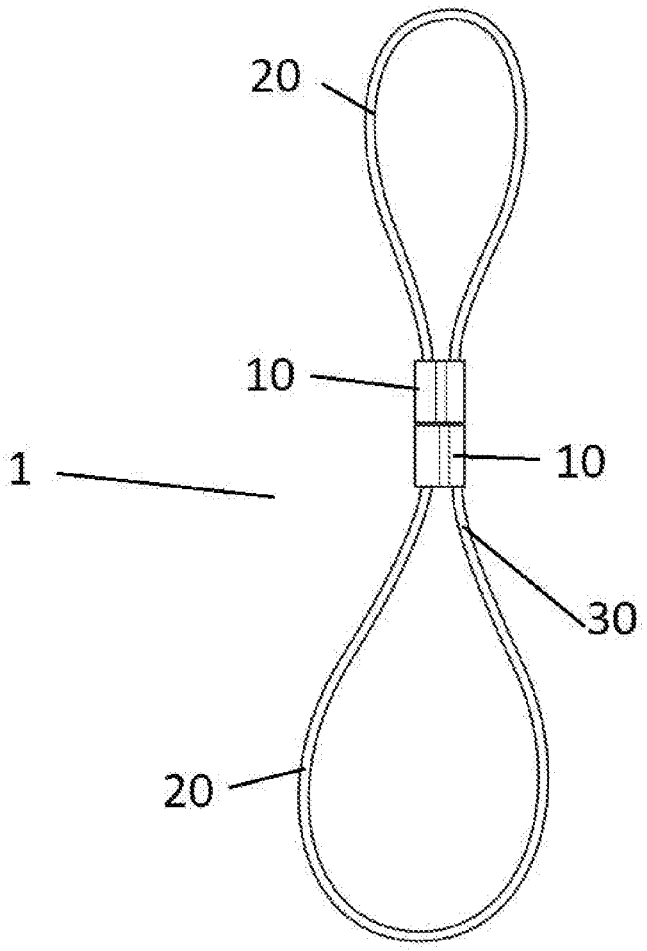
FIG. 1 shows the security cable with two loops.

As shown in FIGS. 1 through 5, the current invention is a preassembled cable tether 1 for computer, cords and adapter security and theft Prevention. The cable tether 1, as shown in FIG. 1, has a loop 20 at each end of the cable 30 with a crimp-able metal sleeve 10 at each end used to form the loops 20. The end of the cable 30 is attached to the sleeve 10 forming the end of the loop 20 while the cable 30 loops back through the sleeve 10 forming the loop. This end of the cable 30 can slide within the sleeve 10.

Figure 2:
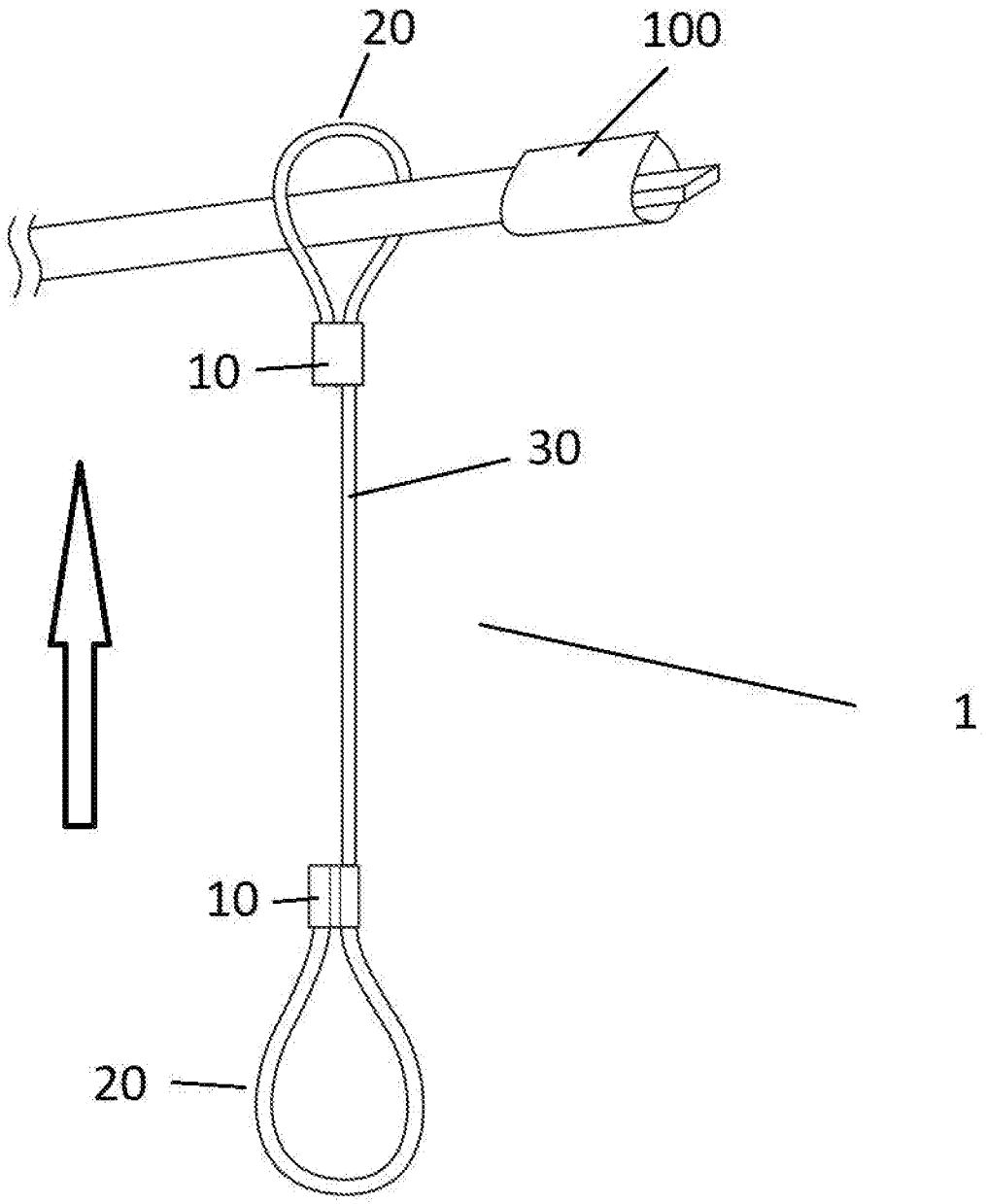
FIG. 2 shows the security cable being attached to the item to be secured.

As shown in FIG. 2, the loop 20 is placed around the item 100 to be protected or secured. The loop 20 is at one permanently attached and crimped to the sleeve 10 in such a way to allow the other end of the loop to slide in the sleeve 10 for installation. The cable 30 is adjusted by pulling the cable 30 through the sleeve 10. Once it is tight enough that sleeve 10 is crimped against the cable 30 holding the adjustable end of the loop in place and forming a secured loop 20 securing the item 100. This can be done at the other end of the cable tether 1 to secure the item 100 to an object, base, table or computer protecting it from getting lost, stolen or taken.

Figure 3:
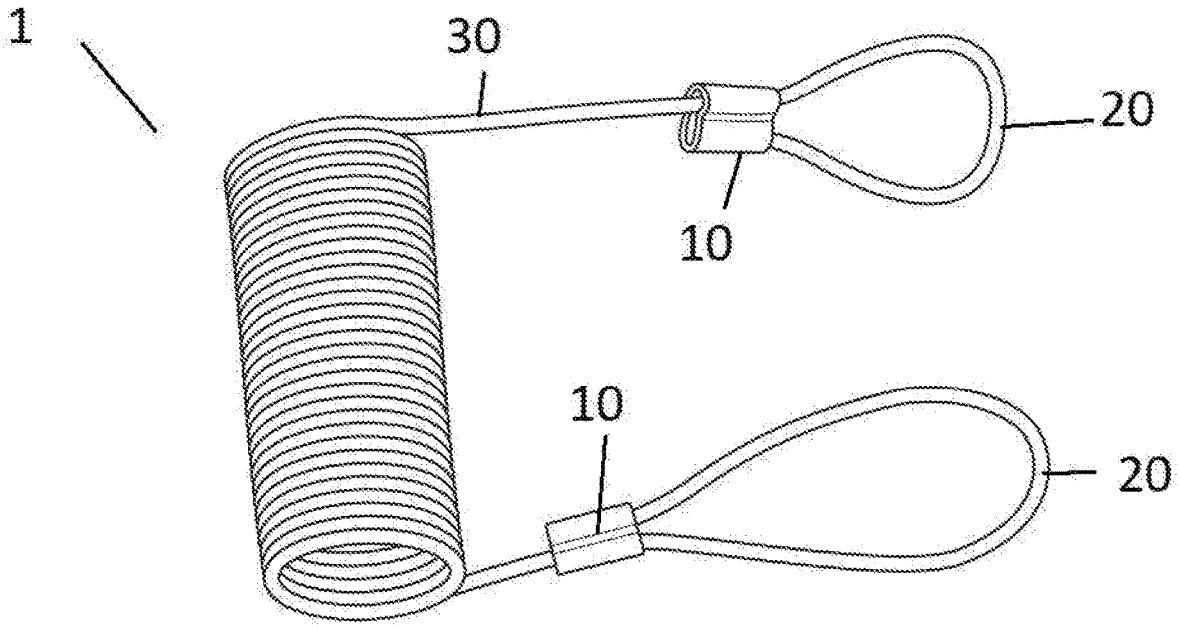
FIG. 3 shows a coiled two loop cable.

The cable 30 cannot be removed once installed. A longer cable 30 may be used which can be coiled as shown in FIG. 3.

Figure 4:
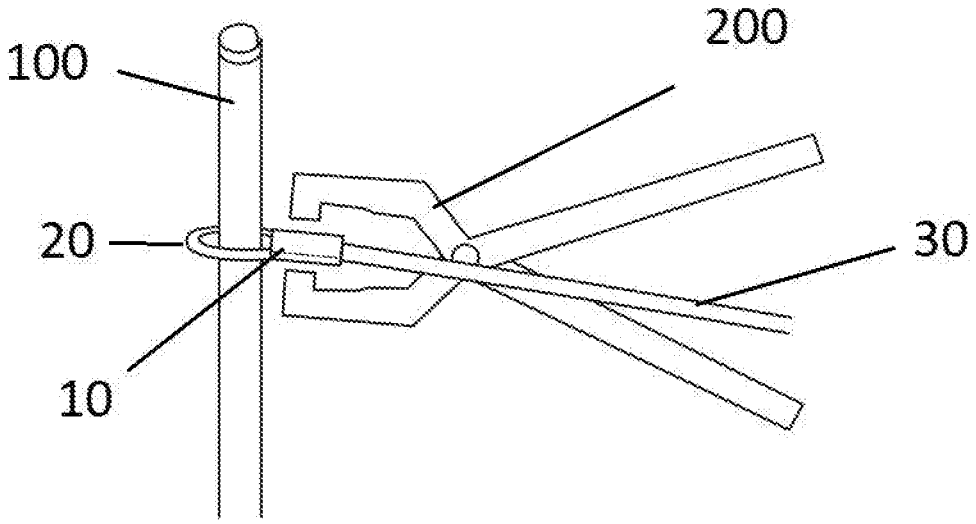
FIG. 4 shows a crimping device being used to crimp the sleeve.

Once the loop 20 is tight enough the sleeve 10 will be crimped which can be done by a crimping device as shown in FIG. 4. In some designs the sleeve 10 can be cramped by hand or by twisting to secure the cable 30. The crimping can be invisible as shown by the top sleeve 10 in FIG. 2.

The cable 30 is made of a high-quality, flexible, stainless-steel coated wire cable. The coating can by any fiction resistance material such as nylon, Teflon, or PVC. The sleeve 10 is normally made of metal but other material can be used including heat sensitive material where the sleeve 10 is heated to connect to the cable 30.

Figure 5:
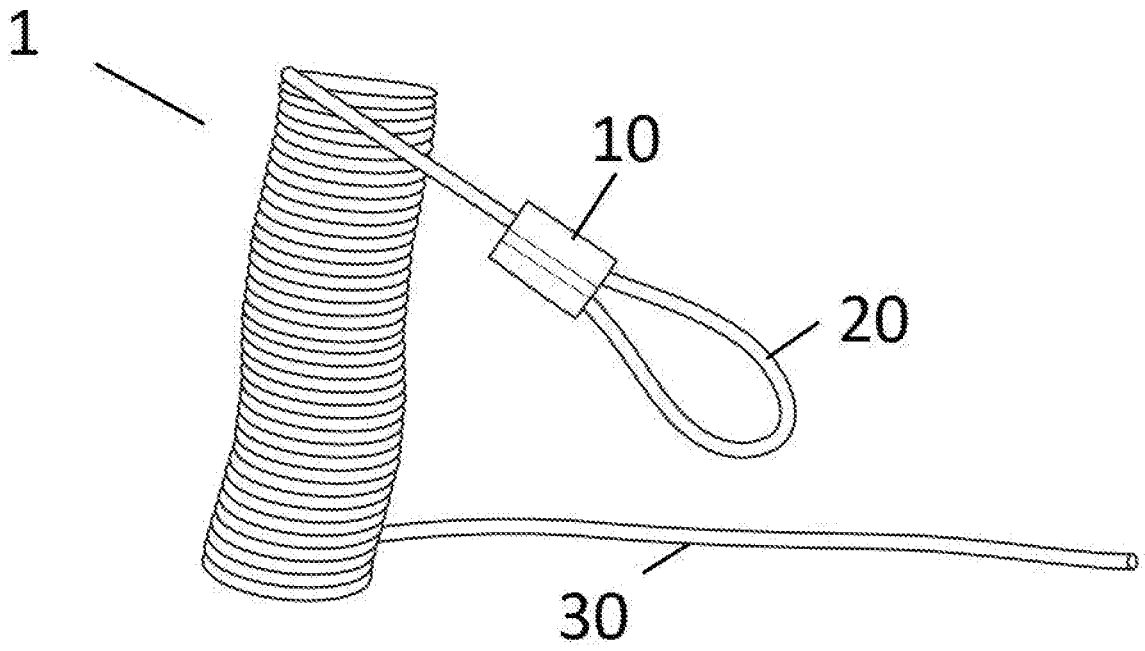
FIG. 5 shows a one loop cable.

Some applications may require a single loop 20 design as shown in FIG. 5.

The cable tether 1 is easy to use and quick to install normally less than 15 seconds each. The cable tether 1 is preassembled.

Advantages

The cable tether 1 can be install permanently in under 15 seconds. It features a tamper-resistant design reducing the chance of loss and theft. It is cheap and inexpensive.

Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided. With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

That which is claimed is:

1. A securing device comprising:

a cable and a plurality of crimpable sleeves, each sleeve defining a closed interior opening, each end of the cable is permanently attached to a respective sleeve by crimping the end of the cable to a first portion of the interior opening of the sleeve, with the cable running back through a second portion of the interior opening forming an adjustable loop at each end of the cable, where each loop of the cable is adjustable by pulling an uncrimped portion of the cable through the second portion of the interior opening of each sleeve for closing one of the loops around an item to be protected and another of the loops to an object, and where a portion of each sleeve that defines the second portion of the interior opening and having a portion of the cable therein is then crimped onto the cable, thereby securing the loops of the cable in place around the respective item and object.

2. The device according to claim 1 further comprising:

where each sleeve is metal.

3. The device according to claim 1 further comprising:

where the device is pre-assembled.

4. The device according to claim 1 further comprising:

where the loop is adjustable.

5. The device according to claim 1 further comprising:

where the cable is permanently attached to the item to be secured.

6. The device according to claim 1 further comprising:

where each end of the cable is permanently attached to its respective sleeve by crimping.

* * * * *